US007909425B2

(12) United States Patent
Yamada et al.

(10) Patent No.: US 7,909,425 B2
(45) Date of Patent: Mar. 22, 2011

(54) INKJET PRINTING HEAD AND SUBSTRATE HAVING FUSES FOR STORING INFORMATION

(75) Inventors: Hiroshi Yamada, Yokohama (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 12/196,747

(22) Filed: Aug. 22, 2008

(65) Prior Publication Data

US 2009/0058898 A1 Mar. 5, 2009

(30) Foreign Application Priority Data

Aug. 30, 2007 (JP) ..... 2007-224021

(51) Int. Cl.
*B41J 29/393* (2006.01)

(52) U.S. Cl. ..... 347/19; 347/58; 347/63

(58) Field of Classification Search ..... 347/5, 9, 347/12, 56–59
See application file for complete search history.

(56) References Cited

U.S. PATENT DOCUMENTS

| | | | | |
|---|---|---|---|---|
| 5,956,052 | A | 9/1999 | Udagawa et al. | 347/19 |
| 6,231,155 | B1 | 5/2001 | Udagawa et al. | 347/19 |
| 6,460,976 | B1 * | 10/2002 | Oikawa | 347/57 |
| 6,946,718 | B2 * | 9/2005 | Chavarria | 347/59 |
| 7,309,120 | B2 | 12/2007 | Hatsui et al. | |
| 7,364,284 | B2 | 4/2008 | Hatsui et al. | |
| 2007/0008382 | A1 | 1/2007 | Hatsui et al. | |

FOREIGN PATENT DOCUMENTS

| | | |
|---|---|---|
| JP | 3-126560 | 5/1991 |
| JP | 3428683 | 5/2003 |

* cited by examiner

*Primary Examiner* — Juanita D Stephens
(74) *Attorney, Agent, or Firm* — Fitzpatrick, Cella, Harper & Scinto

(57) ABSTRACT

An inkjet printing head includes a substrate capable of storing a large volume of information by increasing a number of fuses without enlarging a space for arranging fuses capable of storing information according to the cutting or non-cutting of the fuses, and a selection circuit. For that purpose, two fuses are connected to a set of a drive element and a selection circuit.

5 Claims, 11 Drawing Sheets

| | FUSE (500a) | | FUSE (500b) | |
|---|---|---|---|---|
| | FUSION CUTTING | READOUT | FUSION CUTTING | READOUT |
| TERMINAL (504a) | 24V | H/L | OPEN | OPEN |
| TERMINAL (504b) | OPEN | 3.3V | OPEN | OPEN |
| TERMINAL (504c) | OPEN | OPEN | 24V | H/L |
| TERMINAL (504d) | OPEN | OPEN | OPEN | 3.3V |

FIG.8

INKJET PRINTING HEAD AND SUBSTRATE HAVING FUSES FOR STORING INFORMATION

BACKGROUND OF THE INVENTION

1. Field of the Invention

The present invention relates to an inkjet printing head substrate and an inkjet printing head using the substrate.

2. Description of the Related Art

As inkjet printing heads used for inkjet printing apparatuses, inkjet printing heads in which ink drops to be ejected are formed by various systems have been known. Among those, an inkjet printing head utilizing heat as energy for ejecting ink can be made into a high-density multi-nozzle printing head with relative ease, and the inkjet printing head is capable of performing high-resolution, high image quality, and high-speed printing.

In order to store information specific to the printing head such as an ID (Identity) code of the printing head itself and a driving characteristic of an ink ejecting mechanism so as to be freely read out in such a printing head, a ROM (Read Only Memory) is installed in the base body of the printing head in some cases. This function is a means extremely useful for performing optimum driving by obtaining information specific to the printing head in printing when an inkjet printing head detachable from an inkjet printing apparatus main body is used. For example, there is disclosed in Japanese Patent Laid-Open No. H3-126560 that an EEPROM (Electrically Erasable Programmable ROM) is installed in a printing head. In accordance with this method, relatively large volumes of data can be stored in the EEPROM.

Further, a technique has been known in which resistance denoting information specific to the head is formed along with a layered film having an ink ejecting mechanism and the like on an inkjet printing head substrate. This technique is useful for a case of a relatively small volume of information. Because the information specific to the inkjet printing head can be obtained when the inkjet printing apparatus reads out a value of the resistance formed in the printing head substrate, it is possible to perform optimum driving for ejecting ink.

Further, there is disclosed in Japanese Patent Publication No. 3428683 that fuses which will be a ROM are formed at the same time of forming a layered film having an ink ejecting mechanism and the like in a base substrate for manufacturing the inkjet printing head substrate. By selectively carrying out fusion cutting of the fuses by controlling a logic circuit formed at the same time of forming the fuses, a state as if the fuses hold binary data can be made according to cutting or non-cutting of fuses.

With respect to such a printing head having a ROM on the printing head substrate, because there is no need to prepare a ROM chip separately from the printing head substrate, the structure thereof is not complicated, and the productivity is satisfactory, and it is possible to accomplish the reduction in size and weight thereof.

However, in inkjet printing heads capable of storing individual information as described above, there are the following problems.

A printing head in which the ROM chip is installed at the outside of the inkjet printing head substrate (hereinafter referred also to as abase substrate) is capable of storing large volumes of data, but is unfavorable for productivity improvement or reduction in size and weight thereof.

Further, when the ROM (hereinafter also referred to as fuses) is provided on the base substrate, the printing head is useful for productivity improvement or reduction in size and weight thereof, but is not suitable for storing a large volume of information. Accordingly, in order to store a large volume of information required for performing high image quality printing, it is necessary to arrange many fuses on the base substrate. Further, in accordance with the arrangement of the fuses, in order to carry out fusion cutting and readout of the fuses, it is necessary to arrange a drive element transistor having the driving ability capable of carrying out fusion cutting of the fuses, and a logic circuit such as a shift register to select a fuse.

In recent years, in order to accomplish high image quality in printing, circuits in base substrates have been made in high density, and further, the base substrates are minimized in size in order to keep the manufacturing costs down. In such a situation, it is difficult to arrange many fuses, drive element transistors, logic circuits, and the like in the base substrate in order to store a large volume of information.

SUMMARY OF THE INVENTION

Therefore, an object of the present invention is to provide an inkjet printing head substrate capable of storing a large volume of information by increasing the number of fuses without enlarging a space for arranging fuses, and to provide an inkjet printing head using the same.

According to a first aspect of the present invention, an inkjet printing head substrate having fuses capable of storing information according to the cutting or non-cutting of the fuses comprises: a driving circuit which is connected to at least two of the fuses through a common energizing path; and an electrode pad to selectively perform energizing of the fuses in order to carry out storing of the information due to the fusion cutting and readout of the information.

An inkjet printing head substrate according to the present invention includes a driving circuit which is connected to at least two fuses in common, and closes an energizing path, and an electrode pad to selectively perform energizing to each of the fuses in order to carry out storing of information due to fusing and readout of the information. In accordance therewith, it is possible to provide the inkjet printing head substrate capable of storing a large volume of information by increasing a number of information storing elements without enlarging a space for arranging information storing elements, and to provide the inkjet printing head using the same.

Further features of the present invention will become apparent from the following description of exemplary embodiments (with reference to the attached drawings).

BRIEF DESCRIPTION OF THE DRAWINGS

FIG. 8 is a table in which the states of terminals during fusion cutting and readout of the respective fuses are listed in the first embodiment;

DESCRIPTION OF THE EMBODIMENTS

First Embodiment

Hereinafter, a first embodiment of the present invention will be described with reference to the drawings.

(Inkjet Printing Apparatus)

Figure 1:
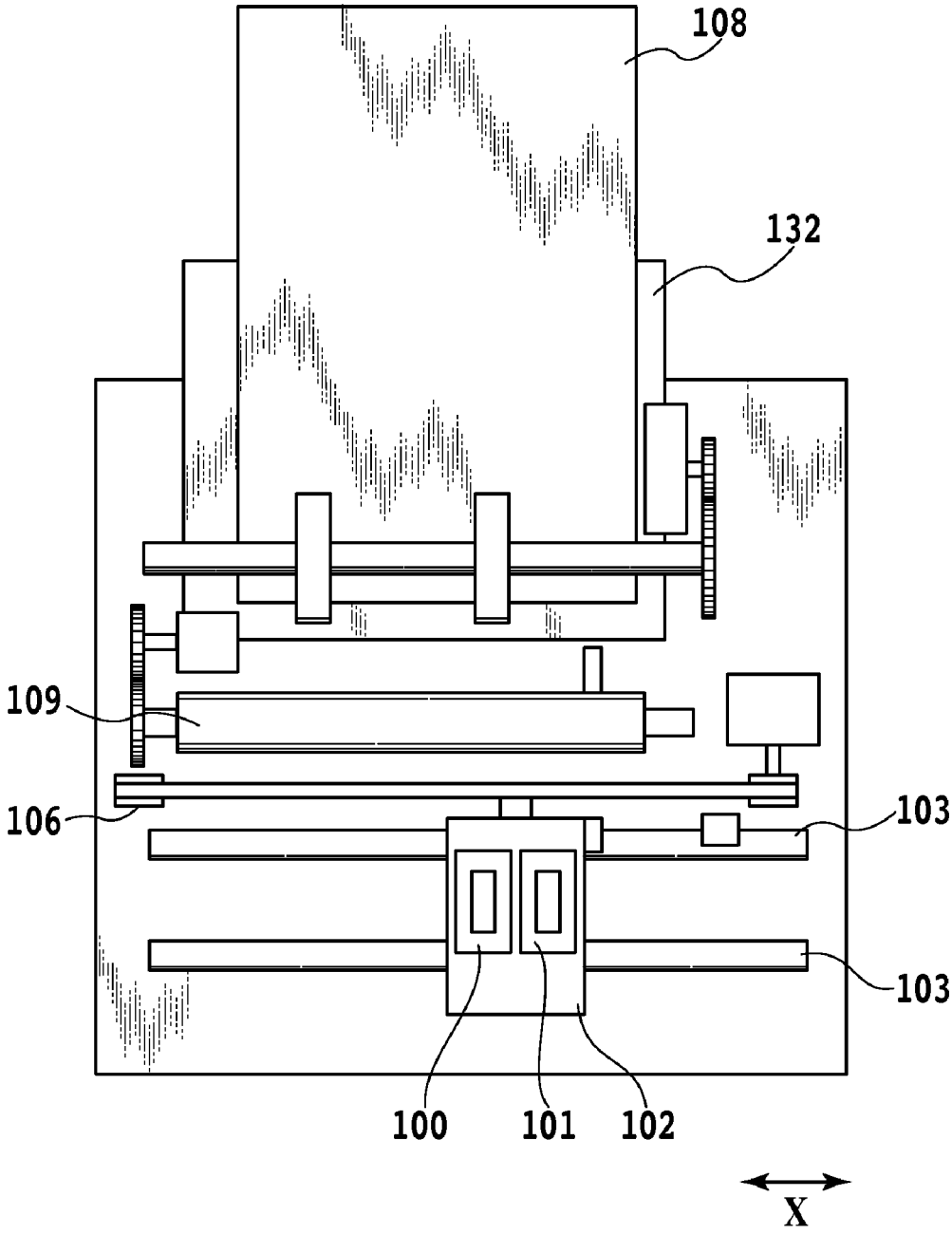
FIG. 1 is a diagram showing a principal part of an inkjet printing apparatus, in which cartridge type printing heads can be mounted, according to a first embodiment.

FIG. 1 is a diagram showing principal parts of an inkjet printing apparatus, in which cartridge type printing heads can be mounted, according to the present embodiment. A black ink printing head 100 and a color ink printing head 101 are mounted on a carriage 102 in an exchangeable manner.

The carriage 102 is supported to be guided in a reciprocable manner along a guide shaft 103 set so as to be extended in a main scanning direction X in an apparatus main body. A printing medium 108 such as a paper or a plastic thin plate etc., is fed separately one by one from an auto sheet feeder (ASF) 132. Moreover, the printing medium 108 passes through a position (a printing unit) facing a plane of ejection ports of printing heads 100 and 101, and is carried (vertically scanned) by the rotation of a carrying roller 109.

The printing heads 100 and 101 are mounted on the carriage 102 such that an array direction of the ejection ports crosses with the scanning direction of the carriage 102, and the printing heads 100 and 101 perform printing by ejecting liquid from these ejection ports.

(Printing Head)

Hereinafter, the printing heads in the present embodiment will be described. However, because the black ink printing head 100 and the color ink printing head 101 have the same basic structures, only the printing head 100 will be described, and description of the printing head 101 will be omitted.

Figure 2A:
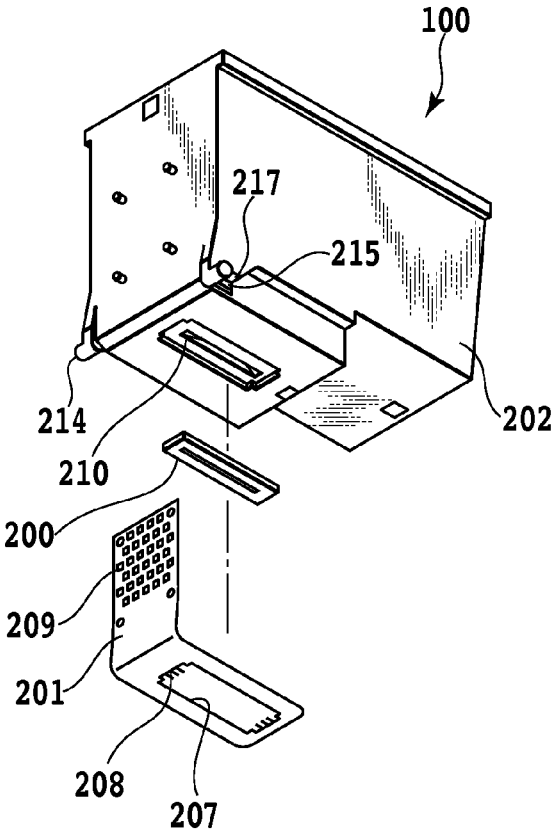
FIG. 2A shows an external structure of the ink tank integrated type printing head in the first embodiment.
Figure 2B:
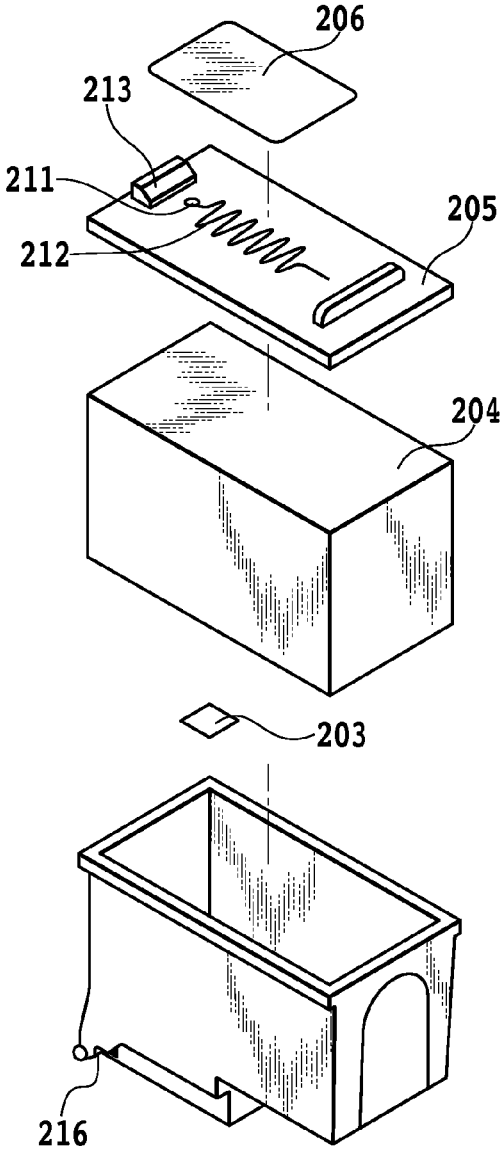
FIG. 2B shows an internal structure of the ink tank integrated type printing head in the first embodiment.

Respectively, FIG. 2A shows an external structure of the ink tank integrated type printing head 100 of the present embodiment, and FIG. 2B shows an internal structure of the ink tank integrated type printing head 100 of the present embodiment. The printing head 100 is fixedly supported by positioning means and an electrical contact of the carriage 102 (refer to FIG. 1) placed on the inkjet printing apparatus main body, and when ink in the ink tank is consumed, the printing head 100 is exchanged. Further, the printing head 100 includes electrothermal transducing elements (hereinafter also referred to as electrothermal transducer) that generate thermal energy to cause film boiling in ink in accordance with an electric signal. The printing head 100 is composed of a printing element substrate 200, an electric wiring tape 201, an ink supply retaining member 202, a filter 203, an ink absorber 204, a cover member 205, and a sealing member 206.

The electric wiring tape 201 is to form an electric signal path through which an electric signal to eject ink is applied to the printing element substrate 200, and an opening portion 207 into which the printing element substrate is built is formed therein. Electrode terminals 208 to be connected to electrode portions 303 of the printing element substrate are formed in the vicinity of the edges of the opening portion 207. Further, an external signal input terminal 209 to receive an electric signal from the main body apparatus is formed on the electric wiring tape 201, and the electrode terminals 208 and the external signal input terminal 209 are connected through a continuous silver foil wiring pattern.

With respect to an electrical connection between the electric wiring tape 201 and the printing element substrate 200, for example, bumps 304 of the electrode portions 303 of the printing element substrate 200 and the electrode terminals 208 of the electric wiring tape 201 corresponding to the electrode portions 303 of the printing element substrate 200 are electrically connected by a thermal ultrasonic compression bonding method.

The ink supply retaining member 202 has a function as an ink tank by having the absorber 204 to store ink therein and generate negative pressure, and a function of ink supply by forming an ink flow channel to guide the ink to the printing element substrate 200. The filter 203 to prevent dust from invading the inside of the printing element substrate 200 is agglutinated by adhesion to the boundary portion with the ink absorber 204 arranged at the upper stream portion of the ink flow channel. An ink supply port 210 to supply ink to the printing element substrate 200 is formed at the downstream portion of the ink flow channel. The printing element substrate 200 is bonded to be fixed to the ink supply retaining member 202 with high positional accuracy such that an ink supply port 301 of the printing element substrate 200 is communicated with the ink supply port 210 of the printing element substrate 200.

Figure 3:
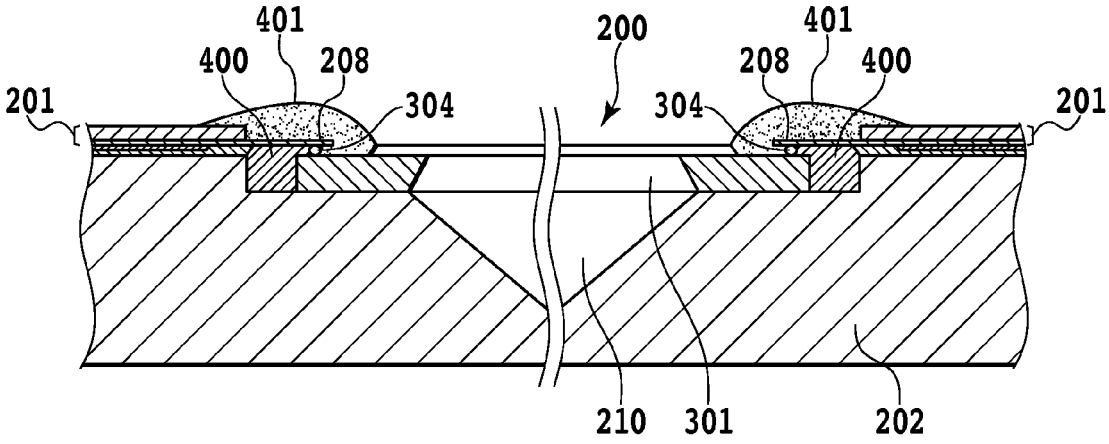
FIG. 3 is a cross-sectional view showing a portion in which an ink supply retaining member, a printing element substrate, and an electric wiring tape are bonded to each other in cross-section.

FIG. 3 is a cross-sectional view showing a portion in which the ink supply retaining member 202, the printing element substrate 200, and the electric wiring tape 201 are bonded to each other in cross-section. The electric connection portion between the printing element substrate 200 and the electric wiring tape 201 is sealed with a first sealant 400 and a second sealant 401, and the electric connection portion is protected from corrosion due to ink and an external impact. The first sealant 400 mainly seals the rear face side of the connection portion of the electrode terminals 208 of the electric wiring tape 201 and the bumps 304 of the printing element substrate, and the outer peripheral portion of the printing element substrate 200, and the second sealant 401 seals the front side of the connection portion with the bumps 304 of the printing element substrate. Then, the portion of the electric wiring tape 201 which is not to be bonded is bent, and is fixed to a side surface substantially perpendicular to the bonding plane of the printing element substrate 200 of the ink supply retaining member 202 by thermal caulking, adhesion, or the like.

The ink supply retaining member 202 of the printing head 100 includes an installing guide 214 to guide the printing head 100 to an installing position of the carriage 102 of the inkjet printing apparatus main body, and a catching part 213 to install and fix the printing head 100 to the carriage by a head set lever. Further, the ink supply retaining member 202 includes a bumper portion 215 along a carriage scanning direction, a bumper portion 216 along a printing medium carrying direction, and a bumper portion 217 along an ink ejecting direction, which are for positioning the ink supply retaining member 202 at a predetermined installing position of the carriage. Due to the positioning by these bumper portions, in the ink supply retaining member 202, the external signal input terminal 209 on the electric wiring tape 201 precisely makes an electrical contact with a contact pin of the electric connection portion provided in the carriage.

Figure 4:
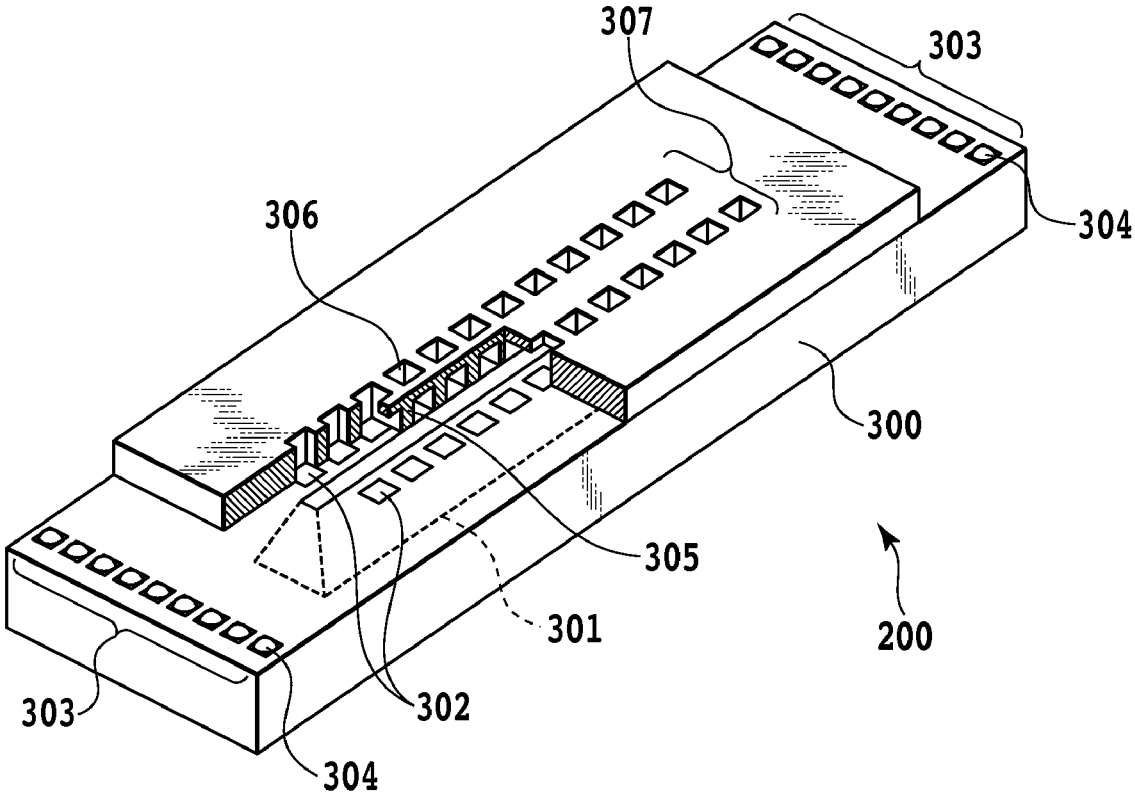
FIG. 4 is a perspective view showing a part of the structure of the printing element substrate in cross-section for explanation thereof.

FIG. 4 is a perspective view showing a part of the structure of the printing element substrate 200 in cross-section for explanation thereof. In the printing element substrate 200, the ink supply port 301 which is a long slot shaped through opening serving as an ink flow channel, is formed in an Si substrate 300 with a thickness of, for example, 0.5 to 1 mm by a method such as anisotropic etching or sandblasting utilizing a crystal orientation of Si.

On both sides sandwiching the ink supply port 301, electrothermal transducing elements 302 are formed so as to be arranged in one line, respectively, and further, unillustrated electric wirings which are formed of Al or the like, that supply electric power to the electrothermal transducing elements 302, are formed. These electrothermal transducing elements 302 and electric wirings are formed by a film formation technology, and TaSiN or the like is used as a material of the electrothermal transducing elements 302. The electrothermal transducing elements 302 are aligned in zigzags on both sides sandwiching the ink supply port 301. That is, the electrothermal transducing elements 302 are arranged to be slightly shifted such that the positions of the ejection ports in the respective lines are not aligned along a direction perpendicular to the array direction. Moreover, the electrode portions 303 that supply electric power to the electric wirings and supply electric signals to drive the electrothermal transducing elements 302 are formed to be aligned along the sides on both outer sides of the electrothermal transducing elements 302, and the bumps 304 formed of Au or the like are formed on the electrode portions 303.

An ink flow channel wall 305 forming the ink flow channel corresponding to the electrothermal transducing elements 302 and a ceiling portion that covers the upper portion thereof are formed on the plane on which a pattern of wirings, resistive elements, and the like are formed, on the Si substrate 300. Then, a structural body formed of a resin material in which ejection ports 306 are provided, is formed at the ceiling portion by a photolithography technique. The ejection ports 306 are provided so as to face the electrothermal transducing elements 302, and form an ejection port group 307. In the printing element substrate 200, the ink supplied from the ink supply port 301 is ejected from the ejection ports 306 by pressure of air bubbles generated due to heat generation from the respective electrothermal transducing elements 302.

Figure 5:
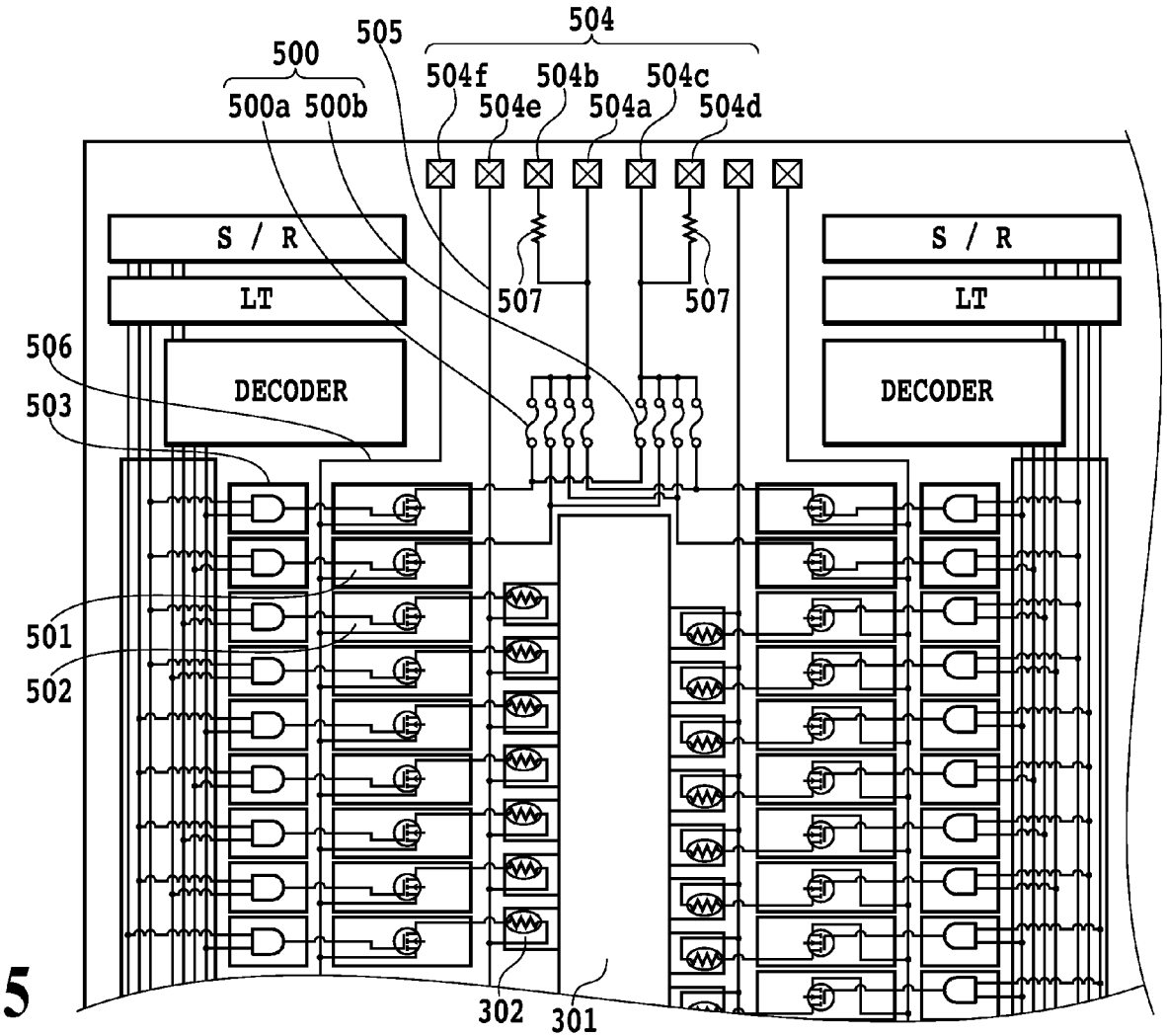
FIG. 5 is a plan view of an inkjet printing head substrate according to the first embodiment, which is a diagram shown for making the internal circuit clear.

FIG. 5 is a plan view of the inkjet printing head substrate (hereinafter also referred as to the printing head substrate simply) according to the present embodiment, which is a diagram shown for making the internal circuit clear.

In the printing head substrate, semiconductor elements and wirings are formed by a semiconductor manufacturing process on the Si substrate 300. Fuses 500 for storing information specific to the head are formed in the inkjet printing head substrate. The fuses 500 are formed as polysilicon resistors in the present embodiment. However, the fuses 500 may be formed of a material the same as that of the electrothermal transducing elements 302. Then, the fuses 500 are arranged on the short side of the ink supply port 301. A transistor mode second drive element 501 that turns on and off an energizing path to selectively carry out fusion cutting of the fuses 500 or readout of the states thereof is arranged to be adjacent to a transistor mode first drive element 502. As a selection signal that selectively drives the second drive element 501, a signal that selects the electrothermal transducing elements 302 is used as is, and therefore, the fuses can be selected in the same ways as the electrothermal transducing elements 302. A selection circuit 503 that finally selects the second drive element 501 from a signal line outputted by a shift register or the like is an AND circuit which is the same as a circuit that selects the first drive element 502 to drive the electrothermal transducing elements 302. That is, the second drive element 501 is driven by use of a same circuit that selects the first drive element 502 via the shift register, a latch circuit, and a decoder from a signal line inputted from the outside of the inkjet printing substrate.

Note that a VH power supply wiring 505 extending from a VH power supply pad 504*e* to supply a VH power source to the electrothermal transducing elements 302 is connected to the electrothermal transducing elements 302. Then, a GNDH power supply wiring 506 extending from a GNDH power supply pad 504*f* to supply a GNDH power source is used in common by the first drive elements 502 connected to the electrothermal transducing elements 302 and the second drive elements 501 connected to the fuses 500.

Figure 6:
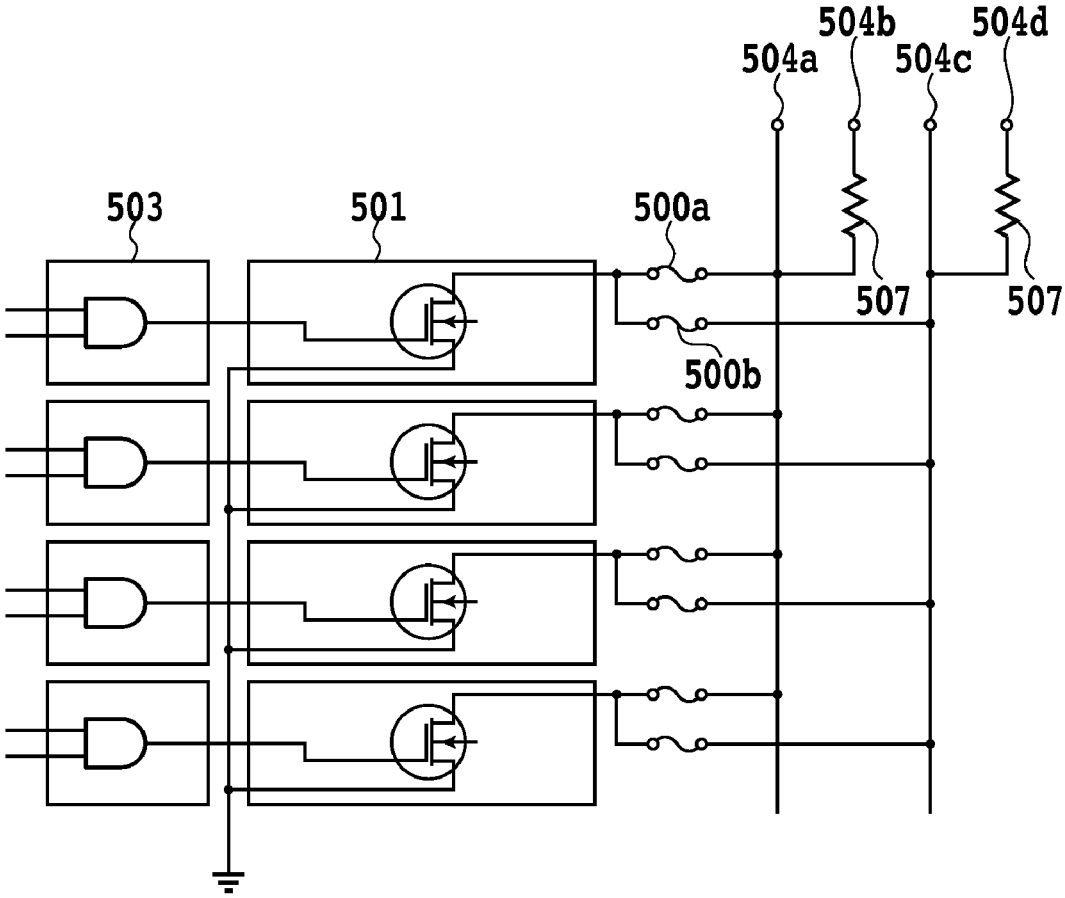
FIG. 6 is a diagram showing an equivalent circuit of circuits in which fuses, a second drive element, and a selection circuit are connected, of the inkjet printing head substrate according to the first embodiment.

FIG. 6 is a diagram showing an equivalent circuit of circuits in which the fuses 500, the second drive element 501, and the selection circuit 503 are connected, of the inkjet printing head substrate according to the present embodiment. Two fuses 500*a* and 500*b* are respectively connected to a set of the second drive element 501 and the selection circuit 503. An arranging area for the second drive element 501 and the selection circuit 503 is made much greater than an area required for installing the fuses 500 therein, in order to satisfy the driving ability for carrying out fusion cutting of the fuses 500. Therefore, when the fuses are arranged in the inkjet printing head substrate, the number of fuses which can be installed in the substrate is determined in accordance with an arranging area for which the second drive element 501 and the selection circuit 503 can include.

Figure 7:
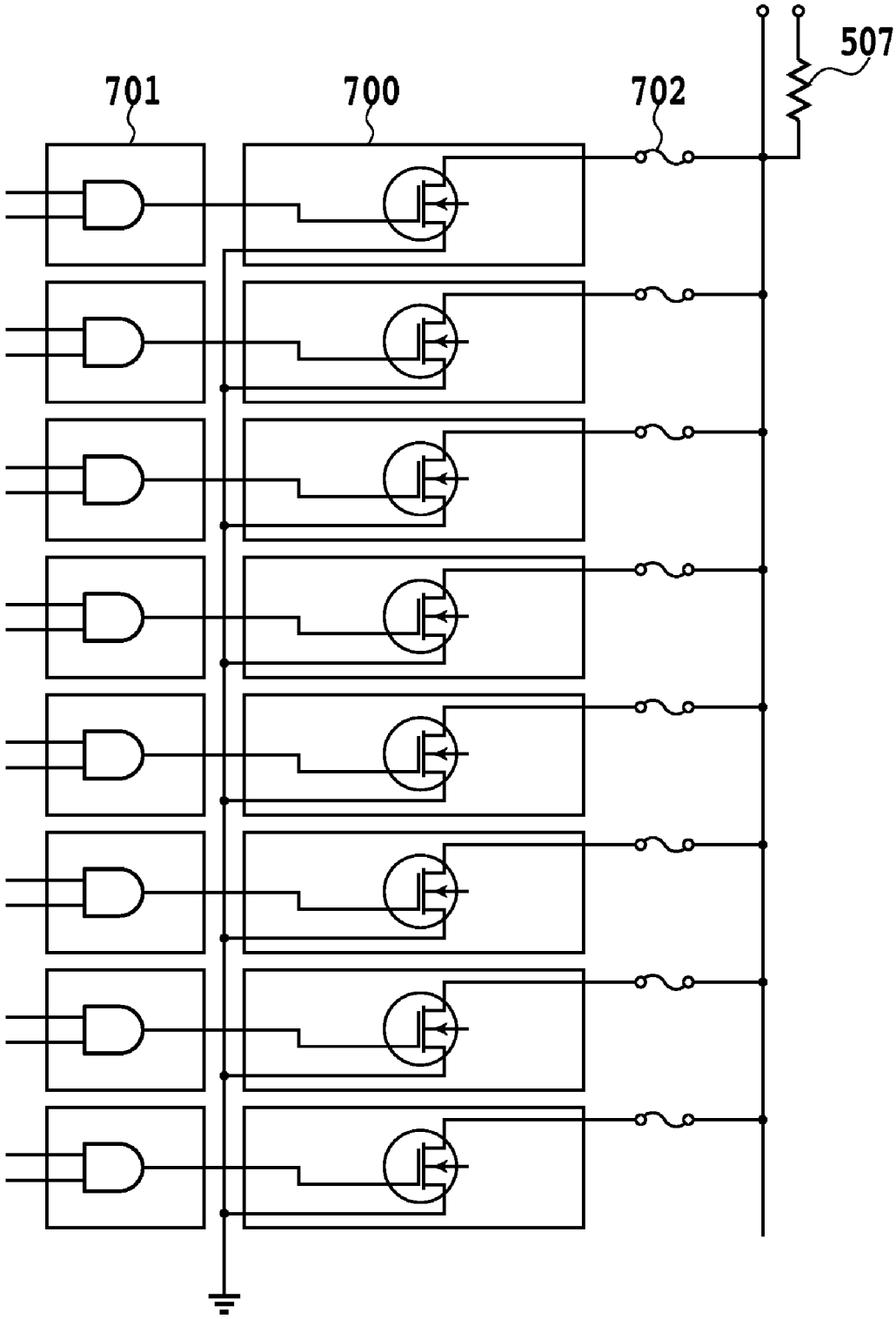
FIG. 7 is a diagram showing an equivalent circuit of circuits in which a fuse, a second drive element, and a selection circuit are connected, of a conventional printing head substrate.

FIG. 7 is a diagram showing an equivalent circuit of circuits in which a fuse, a second drive element, and a selection circuit are connected, of a conventional printing head substrate. In a structure in which one fuse 702 is connected to a set of a second drive element 700 and a selection circuit 701 as in the conventional art, anew space which is the same as an arranging area for the second drive element 700 and the selection circuit 701 is required in order to increase the number of fuses. Therefore, the substrate is increased in size, which leads to an increase in manufacturing cost. Or, if the substrate is not changed in size and the increase in the number of fuses is suppressed, a volume of information which can be stored is decreased, which makes it impossible to store all the necessary information specific to the head.

Then, in the present embodiment, as shown in FIG. 6, the two fuses 500*a* and 500*b* are connected to a set of the second drive element 501 and the selection circuit 503. Accordingly, even if the number of fuses is increased to double that in the conventional art, the number of sets of the second drive element 501 and the selection circuit 503 does not vary. Because not such a large space is required in order to arrange fuses, it is possible to increase the number of fuses to be installed in the substrate without increasing the substrate in size.

ID pads 504*a*, 504*c* and ID power supply pads 504*b*, 504*d* are used during fusion cutting of the fuses and during readout of the information. Between the two fuses connected to a set of the second drive element 501 and the selection circuit 503, the one fuse 500*a* is connected to the ID pad 504*a* and the ID power supply pad 504*b*, and the other fuse 500*b* is connected to the ID pad 504*c* and the ID power supply pad 504*d*. By connecting them in this way, it is possible to carry out fusion cutting and readout of the information of the two fuses independently. Note that a method for selecting fuses of which fusion cutting and readout of the information are carried out from a plurality of fuses is the same as in the conventional art. That is, it is possible to select fuses in the same way as the electrothermal transducing elements 302.

Fusion cutting and readout of the information of the fuse 500*a* will be described. During fusion cutting and readout of the information of the fuse 500*a*, the ID pad 504*c* and the ID power supply pad 504*d* connected to the fuse 500*b* are in an open state. The ID pad 504*a* functions as a fuse cutting power supply terminal to energize during fusion cutting of the fuse 500*a*, and functions as a signal output terminal during readout of the information by the fuse. That is, during fusion cutting of the fuse 500*a*, a voltage (for example, a voltage of 24V to drive the electrothermal transducing elements) is applied to the ID pad 504*a*, and the second drive element 501 selected by the selection circuit 503 is driven to carry out fusion cutting of the corresponding a fuse 500*a* momentarily. At this time, the ID power supply pad 504*b* serving as a power supply terminal for readout of fuse is in an open state. On the other hand, during readout of the information, the process is carried out by the following method. By applying a voltage (for example, of 3.3 V which is a power supply voltage for a logic circuit) to the ID power supply pad 504*b*, in a case in which fusion cutting of the fuse 500*a* is brought about, a Hi level is outputted to the ID pad 504*b*. Further, in a case in which fusion cutting of the fuse 500*a* is not brought about, a Low level is outputted to the ID pad 504*a* by a readout resistance 507 clearly higher than a resistance value of the fuse 500*a*.

With respect to fusion cutting and readout of the information of the fuse 500*b*, it suffices to carry out the control which is the same as described above for the ID pad 504*c* and the ID power supply pad 504*d*. At this time, the ID pad 504*a* and the ID power supply pad 504*b* connected to the fuse 500*a* are in an open state. FIG. 8 is a table in which the states of terminals during fusion cutting and readout of the respective fuses are listed.

As described above, by connecting two fuses to a set of a second drive element and a selection circuit, there is no need to increase a space required for arranging the second drive element and the selection circuit while increasing the number of fuses more than that in the conventional art. In accordance therewith, it is possible to increase the number of fuses to be installed in the printing head substrate without increasing the printing head substrate in size. Accordingly, the inkjet printing head substrate including a high-density circuit, which is capable of storing a relatively large volume of information in order to bring about the realization of high image quality in printing, can be realized.

Note that, in the present embodiment, the structure in which the two fuses are connected to a set of the second drive element and the selection circuit has been exemplified. However, it is a matter of course that it is possible to achieve the desired object of the present invention even if three or more fuses are connected thereto.

Second Embodiment

Next, a second embodiment of the present invention will be described. Note that, because the basic structure of the second embodiment is the same as that of the first embodiment, description thereof will be omitted, and only the characteristic portions will be described.

Figure 9A:
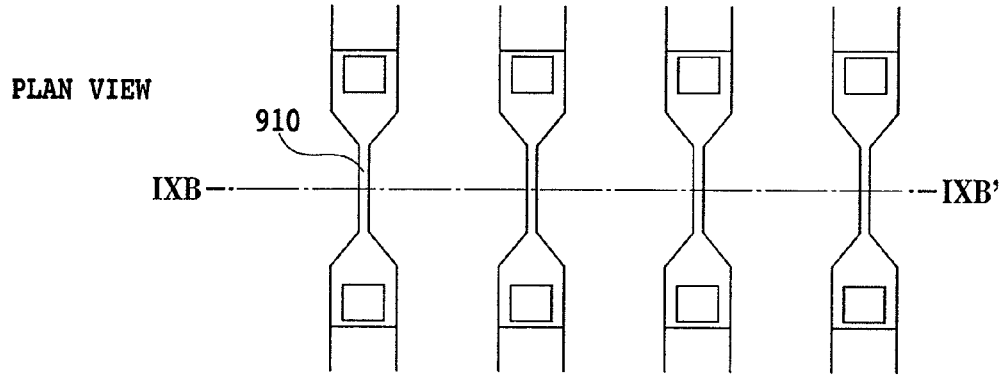
FIG.9A PRIOR ART
FIG. 9A is a top view of conventional fuses.
Figure 9B:
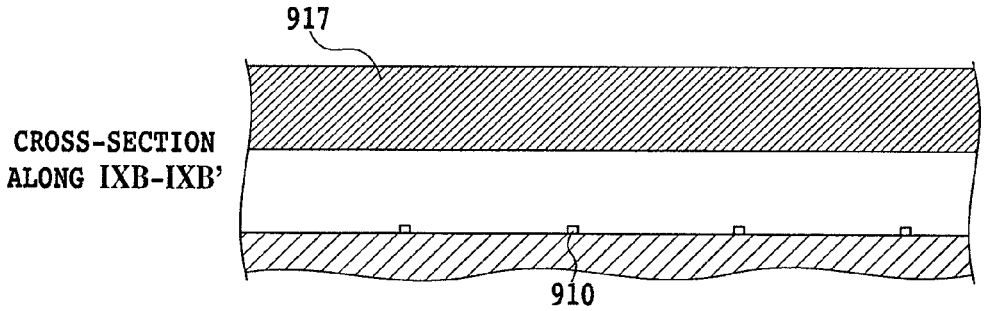
FIG.9B PRIOR ART
FIG. 9B is a cross-sectional view taking a side view of the conventional fuses.

FIG. 9A is a top view showing fuses provided to the conventional inkjet printing head substrate, and FIG. 9B is a cross-sectional view taking a side view thereof.

With respect to the conventional inkjet printing head substrate, a film in which a fuse array composed of many fuses 910 is provided is formed so as to be laminated along with various layered films having an ink ejecting mechanism or the like on their surfaces, and, a protective film 917 is formed thereon. Because the fuse array has been formed in only one layer in the conventional art, in order to increase the number of fuses, it has been necessary to increase an arranging area. That is, the substrate has been increased in size, which has been unfavorable to productivity improvement and miniaturization.

Figure 10A:
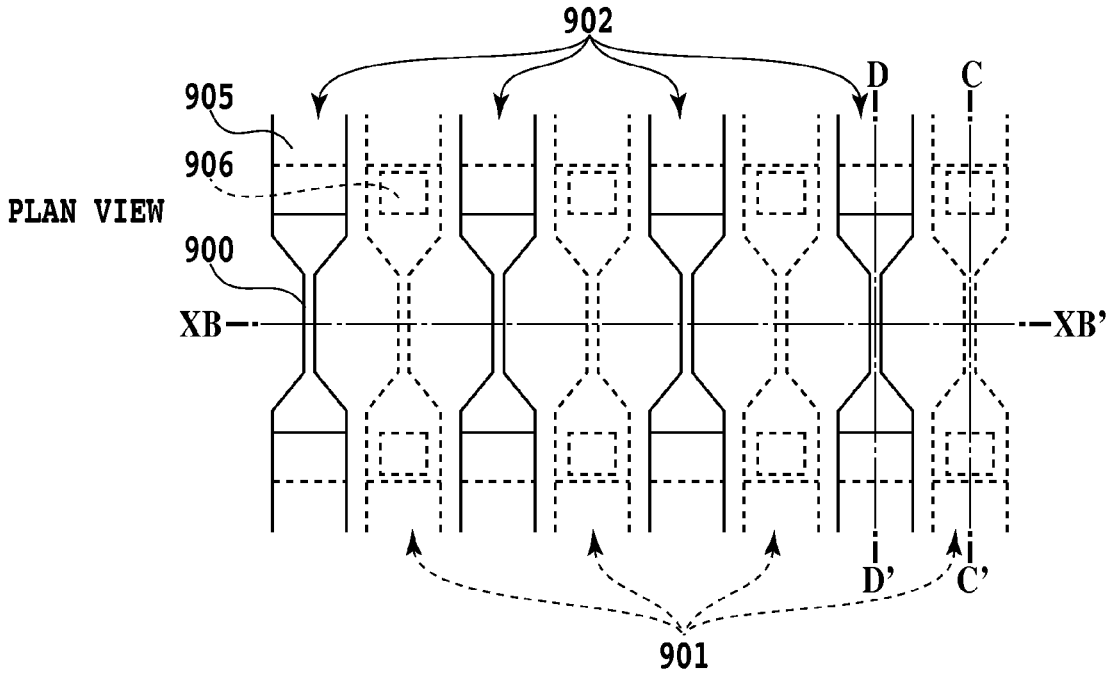
FIG. 10A is a top view of fuses in a second embodiment.
Figure 10B:
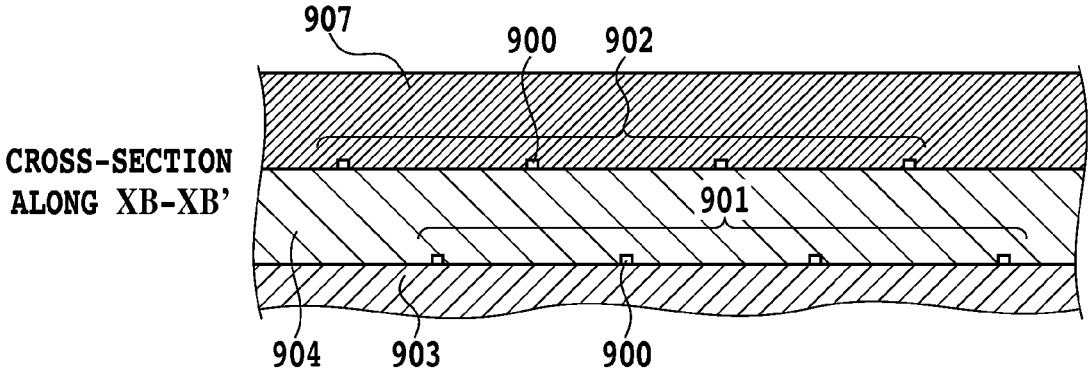
FIG. 10B is across-sectional view taking a side view of the fuses in the second embodiment.

FIG. 10A is a top view showing fuses provided to the inkjet printing head substrate according to the present embodiment, and FIG. 10B is a cross-sectional view taking a side view thereof.

With respect to the inkjet printing head substrate according to the present embodiment, a plurality of films which a fuse array composed of many fuses 900 is provided are formed so as to be laminated along with various layered films having an ink ejecting mechanism or the like on their surfaces. A first fuse array 901 is composed of a layered film of polysilicon resistors laminated on the surface of a printing head substrate 903, and an interlayer insulation film 904 is formed as a layer on the first fuse array 901. Al wirings 905, the electrothermal transducing elements 302, and the like are laminated on the interlayer insulation film 904, and the Al wirings 905 are connected to one another via through-holes 906 of the interlayer insulation film 904. When a voltage is applied to both ends of one of the fuses 900 via the Al wirings 905, fusion cutting of the fuse 900 is momentarily carried out. The state occurs that information of binary data is stored in the fuse 900 according to the cutting or non-cutting of fuses 900.

Further, a second fuse array 902 is laminated into a predetermined shape by using the same material as the electrothermal transducing elements 302 in the upper layer of the interlayer insulation film 904 at the same time of forming the electrothermal transducing elements 302, and the second fuse array 902 is connected via the Al wirings 905. Moreover, a protective film 907 or the like is appropriately laminated thereon.

Here, due to the local heat generation caused during fusion cutting of the fuses 900, the film above and under or near the fuses 900 is damaged in some cases. Therefore, it is necessary not to damage the second fuse array 902 in the upper layer at the time of fusion cutting of the first fuse array 901. In contrast thereto, it is necessary not to damage the first fuse array 901 in the lower layer at the time of fusion cutting of the second fuse array 902. Therefore, in the present embodiment, the first fuse array and the second fuse array are arranged in zigzags so as not to be not overlapped in a direction perpendicular to the surface of the printing head substrate.

In this way, by forming the fuse arrays respectively in the different films provided on the plane of the printing head substrate in a direction perpendicular to the surface of the printing head substrate, it is possible to further reduce a space for arranging the fuse arrays, and increase the number of the fuses.

Third Embodiment

Next, a third embodiment of the present invention will be described. Note that, because the basic structure of the third embodiment is the same as those of the first and second embodiments, description thereof will be omitted, and only the characteristic portions will be described.

Figure 11A:
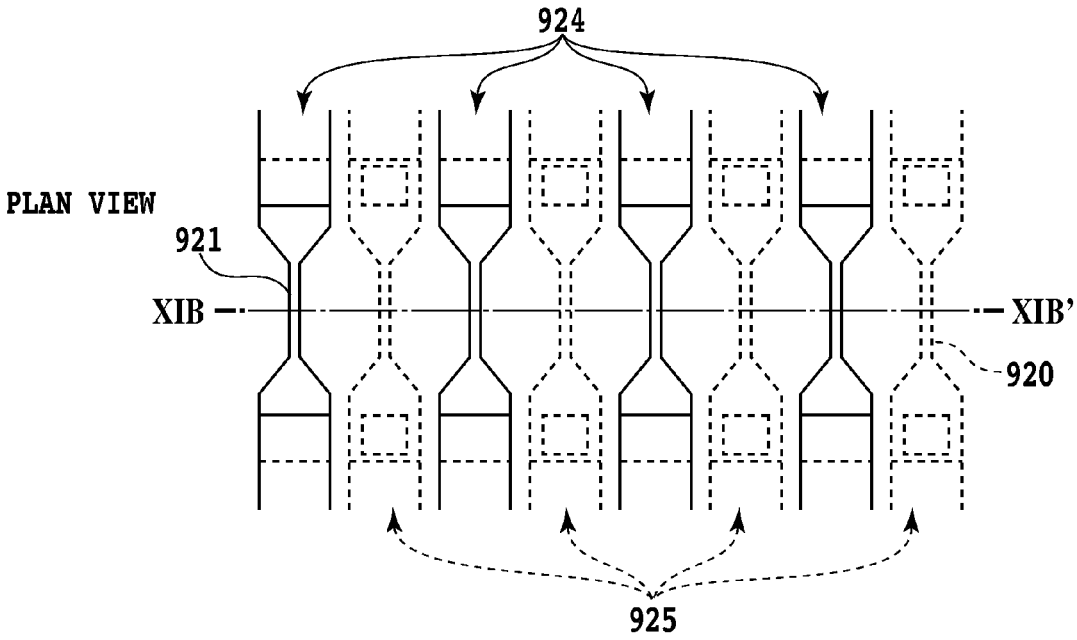
FIG. 11A is atop view of fuses in a third embodiment.
Figure 11B:
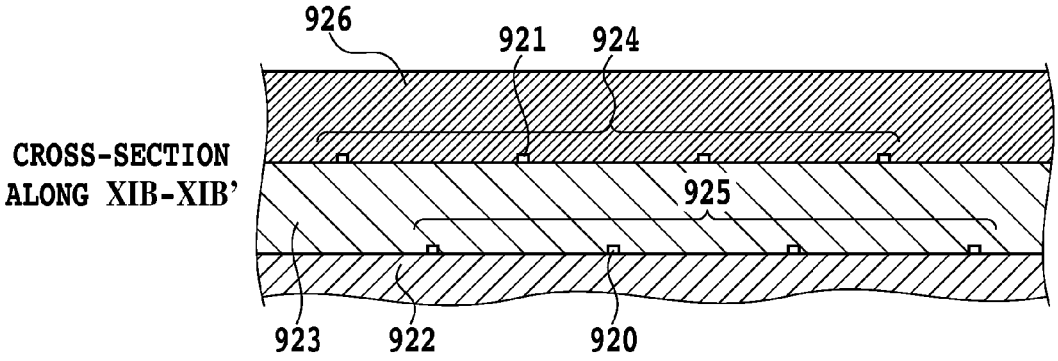
FIG. 11B is across-sectional view taking a side view of the fuses in the third embodiment.

FIG. 11A is a top view showing fuses provided to the inkjet printing head substrate according to the present embodiment, and FIG. 11B is a cross-sectional view taking a side view thereof.

In the present embodiment as well, the fuse arrays are formed separately in a plurality of films in the same way as in the second embodiment. However, the present embodiment is different from the second embodiment in the point that some of the fuses are formed of a thin membrane. The details thereof will be described hereinafter.

As described above, the fuses generate a large amount of heat during fusion cutting thereof. Due to the local heat generation, the interlayer insulation film or the protective film on the fuses is cracked in some cases. In this case, ink adhered on the surface of the printing head substrate (ink mist or residual ink in a recovery operation, or the like) penetrates up to the position of the fuses through the cracks, and the fuses having undergone fusion cutting are short-circuited by the ink, or the fuses and the wirings connected to the fuses are corroded in some cases.

Then, in the present embodiment, in a second fuse array 924 formed in an upper layer near the surface of the printing head substrate, the fuses are formed of a membrane thinner than that of a first fuse array 925 formed in the lower layer thereof. With respect to the first fuse array 925, because an interlayer insulation film 923 and a protective film 926 are laminated in the layers above the fuses, even if those are cracked, it is hard for the cracks to reach the surface of the printing head substrate on which the ink is adhered. Because only the protective film 926 is laminated on the second fuse array 924, if large cracks are caused, there is a possibility that the cracks will reach the surface of the printing head substrate on which the ink is adhered. Therefore, in order to carry out fusion cutting with even a small amount of heat, fuses 921 of the second fuse array 924 are formed of a thin membrane. In accordance therewith, there are no cases in which large cracks are caused in the protective film 926, and it is possible to avoid ink invasion of the fuse circuit portion.

As described above, by forming the fuse arrays respectively in the different films provided on the plane of the printing head substrate in a direction perpendicular to the surface of the printing head substrate, it is possible to increase the number of fuses without enlarging a space for arranging the fuse arrays. Additionally, by employing the structure in which the fusing energy required for fusion cutting of the fuses formed in the upper layer is less than that for the fuses formed in the lower layer, the cracks in the protective film will not reach the surface of the substrate, and the problems such as corrosion of the fuse circuit due to ink invasion will be prevented.

Note that, in the second and third embodiments, the structures of the fuse arrays are formed in two different layers in a direction perpendicular to the surface of the substrate. However, it is a matter of course without saying that fuse arrays may be formed in three or more layers.

Further, in the respective embodiments, the fuses are used as elements to store information therein. However, those are not limited to the fuses, and other information storing elements capable of storing information therein may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-224021, filed Aug. 30, 2007, which is hereby incorporated by reference herein in its entirety.

What is claimed is:

1. An inkjet printing head substrate having fuses capable of storing information according to the cutting or non-cutting of the fuses, comprising:

a driving circuit which is connected to at least two of the fuses through a common energizing path; and an electrode pad to selectively perform energizing of the fuses in order to carry out storing of the information due to the cutting of the fuses and readout of the information, wherein a plurality of the fuses are provided in a plurality of films which are laminated.

2. The inkjet printing head substrate according to claim 1, further comprising electrothermal transducing elements that generate thermal energy utilized for ejecting ink in accordance with energizing, wherein the fuses are formed of the same material as the electrothermal transducing elements.

3. The inkjet printing head substrate according to claim 1, wherein the fuses provided in a film in an upper portion among the plurality of films are capable of being cut by energy less than that of the fuses provided in a film in a lower portion thereof.

4. The inkjet printing head substrate according to claim 1, wherein the plurality of fuses provided in the plurality of films are arranged so as not to be overlapped in a direction perpendicular to the surface of the printing head substrate.

5. An inkjet printing head comprising the inkjet printing head substrate according to claim 1.

* * * * *